US007150800B2

(12) United States Patent
Nishio et al.

(10) Patent No.: US 7,150,800 B2
(45) Date of Patent: Dec. 19, 2006

(54) PRODUCTION METHOD OF BELT FOR STAINLESS STEEL CONTINUOUSLY VARIABLE TRANSMISSION BELT

(75) Inventors: Katsuhide Nishio, Amagasaki (JP); Masahito Sakaki, Amagasaki (JP); Yoshiyuki Umakoshi, Amagasaki (JP); Kenji Hara, Amagasaki (JP); Kouki Tomimura, Shunan (JP)

(73) Assignee: Nisshin Steel Co., Tokyo (JP)

( * ) Notice: Subject to any disclaimer, the term of this patent is extended or adjusted under 35 U.S.C. 154(b) by 306 days.

(21) Appl. No.: 10/474,990

(22) PCT Filed: Mar. 22, 2002

(86) PCT No.: PCT/JP02/02742

§ 371 (c)(1),
(2), (4) Date: Oct. 16, 2003

(87) PCT Pub. No.: WO02/085548

PCT Pub. Date: Oct. 31, 2002

(65) Prior Publication Data

US 2004/0112481 A1 Jun. 17, 2004

(30) Foreign Application Priority Data

Apr. 17, 2001 (JP) ..... 2001-117699
Apr. 17, 2001 (JP) ..... 2001-117700

(51) Int. Cl.
*C21D 9/40* (2006.01)

(52) U.S. Cl. ..... 148/589

(58) Field of Classification Search ..... 148/589
See application file for complete search history.

(56) References Cited

U.S. PATENT DOCUMENTS 5,640,868 A 6/1997 Lauener

FOREIGN PATENT DOCUMENTS

| | | |
|---|---|---|
| JP | 62-199214 | 9/1987 |
| JP | 2000-063998 | 2/2000 |
| JP | 2002-053936 | 2/2002 |

*Primary Examiner*—Roy King
*Assistant Examiner*—Kathleen McNelis
(74) *Attorney, Agent, or Firm*—The Webb Law Firm

(57) ABSTRACT

When a metastable austenitic stainless steel strip with a value Md(N), which is calculated from a composition, of 20–100 is ring-rolled to a steel belt, the relationship of $-0.3913T+0.5650Md(N)+60.46\epsilon \geqq 65.87$ is established among a material temperature T, an equivalent strain $\epsilon$ and the value Md(N). Due to the controlled rolling, a stainless steel belt for a continuously variable transmission is bestowed with fatigue properties similar or superior to those of a 18%-Ni maraging steel belt. The value Md(N) is defined by the equation of Md(N)=580−520C−2Si−16Mn−16Cr−23Ni−300N−10Mo, and the equivalent strain $\epsilon$ is defined by the equation of $\epsilon=\sqrt{4(1n(1-R))^2/3}$ (R: reduction). Furthermore, the steel belt is stabilized in its quality and profile by confining a variation ΔT of the material temperature T within a range of ±6.4° C.

3 Claims, 5 Drawing Sheets

PRODUCTION METHOD OF BELT FOR STAINLESS STEEL CONTINUOUSLY VARIABLE TRANSMISSION BELT

INDUSTRIAL FIELD

The present invention relates to a ring-rolling method of manufacturing a continuously variable transmission belt from a metastable austenitic stainless steel strip.

BACKGROUND OF THE INVENTION

Such a material with high strength as 18% Ni-maraging steel has been used so far for a continuously variable transmission belt. A metastable austenitic stainless steel is sometimes used for the purpose, as disclosed in JP 2000-63998A. The continuously variable transmission belt is conventionally manufactured by the following steps: A steel strip is formed to a ring shape by plasma- or laser-welding its front and tail ends together. The welded steel strip is heat-treated to eliminate a hardness difference between base and welded parts and smoothened at its edge by barreling. The steel strip is then ring-rolled to a predetermined thickness and stretched to a predetermined circumferential length. Thereafter, the steel strip is nitrided and aged so as to harden its surface layer.

The manufactured steel belt is subjected to a rotation-tensile fatigue test or the like for evaluation of fatigue properties. 18% Ni-maraging steel, which is strengthened by work-hardening and aging (strain-aging), has excellent fatigue properties due to a hard nitrided surface layer and effects of cold-working on mechanical properties. However, 18% Ni-maraging steel is scarcely work-hardened due to its large deformation resistance, so as not to anticipate an increase of strength derived from work-hardening even by ring-rolling with a heavy duty. The heavy-duty rolling often causes damages of a steel strip during rolling, when the steel strip lacks of ductility.

A metastable austenitic stainless steel is also a kind of steel, which is work-hardened or strain-aged by cold-rolling. Its strength is remarkably improved by formation of strain-induced martensite and work-hardening of residual austenite in comparison with 18% Ni-maraging steel, but its strengthening rate is varied in correspondence to a material temperature during rolling. Heat generation and dissipation during rolling put significant effects on mechanical properties of a rolled steel strip or belt. In this consequence, a steel belt manufactured by ring-rolling has thickness, width and cross-sectional hardness deviated in response to a manufacturing season.

In short, it is difficult to manufacture a steel belt, which has stable material strength necessary for use as a continuously variable transmission belt. The difficulty is somewhat caused by mechanical properties of the metastable austenitic stainless steel.

SUMMARY OF THE INVENTION

An object of the present invention is to manufacture a steel belt, which has stable properties necessary for a continuously variable transmission, from a metastable austenitic stainless steel strip by ring-rolling the steel strip under properly controlled conditions.

According to the present invention, a metastable austenitic stainless steel strip is used as a material of a continuously variable transmission belt. The metastable austenitic stainless steel strip preferably has a value Md(N) controlled within a range of 20–100, wherein the value Md(N) is determined by a chemical composition of the steel according to the formula of:

$$Md(N)=580-520C-2Si-16Mn-16Cr-23Ni-300N-10Mo.$$

After the steel strip is formed to a ring shape by welding its front and tail ends together, it is ring-rolled under the condition that a relationship of $-0.3913T+0.5650Md(N)+60.46\epsilon \geqq 65.87$ is established among a material temperature T (° C.), an equivalent strain $\epsilon$ and the value Md(N). The equivalent strain $\epsilon$ is represented by the formula of $\epsilon=\sqrt{4(1n(1-R))^2/3}$, wherein R is a reduction ratio. A temperature of a rolling atmosphere or a surface temperature of the steel strip at a position just before a work roll may be used as the material temperature T. Furthermore, when the steel strip is ring-rolled under the condition that a fluctuation $\Delta T$(° C.) of the material temperature T is confined within a range of ±6.4° C., a rate of strain-induced martensite is controlled to a predetermined value with a tolerance of 5 vol. %.

PREFERRED EMBODIMENTS OF THE INVENTION

Figure 1:
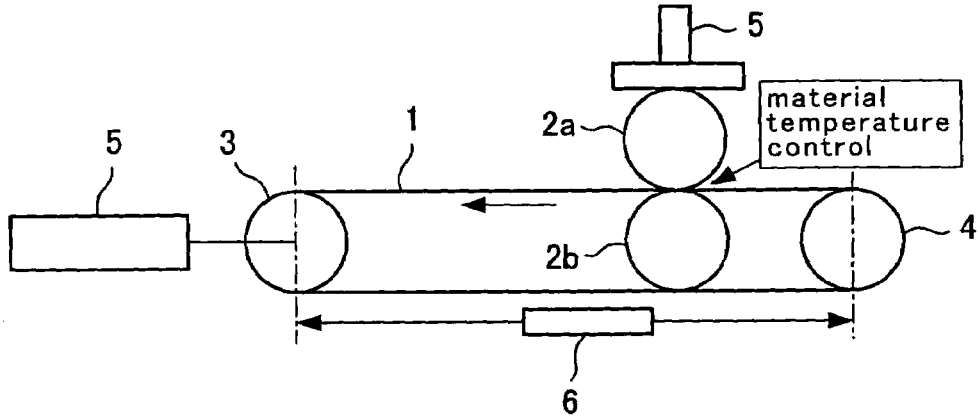
FIG. 1 is a schematic view illustrating a ring-rolling mill.

When a metastable austenitic stainless steel strip is cold rolled, it is strengthened by formation of strain-induced martensite and work-hardening of residual austenite. A rate of strain-induced martensite is varied in response to a temperature and a reduction ratio R during cold-rolling as well as a value Md(N). For instance, formation of strain-induced martensite is intensified as falling of the rolling temperature with the provision that the value Md(N) and the reduction R are constant, resulting in improvement of strength. An increase of the strain-induced martensite also leads to upgrading of cross-sectional hardness.

Dependency of material strength on a rate of strain-induced martensite is advantageously used as a parameter for imparting a predetermined fatigue strength to a steel belt. If a rate of strain-induced martensite, which is formed by ring-rolling, necessary for a certain fatigue strength is known beforehand, such rolling conditions as a material temperature T, an equivalent strain $\epsilon$ and a reduction ratio R can be preset in order to gain the forecast rate of strain-induced martensite.

The inventors have searched and examined effects of compositions, rolling temperatures and strains on a rate of strain-induced martensite for provision of a metastable austenitic stainless steel strip with fatigue strength similar or superior to 18% Ni-maraging steel, and discovered the ring-rolling conditions that properties suitable for a continuously variable transmission belt are imparted to a rolled steel strip without necessity of aging treatment or by moderate aging. That is, when a steel strip is ring-rolled under the condition that a relationship of $-0.3913T+0.5650Md(N)+60.46\epsilon \geqq 65.87$ is established among a material temperature T (° C.), an equivalent strain $\epsilon$ and a value Md(N), strain-induced martensite is formed at a rate necessary for a predetermined fatigue strength. Furthermore, the rate of strain-induced martensite is controlled with a deviation of 5 vol. % by confining a fluctuation $\Delta T$ of the material temperature T within a range of ±6.4° C. during ring-rolling A metastable austenitic stainless steel suitable for the purpose preferably has a value Md(N) within a range of 20–100.

If the value Md(N) is less than 20, strain-induced martensite is not formed at a rate enough to enhance strength, unless a steel strip is ring-rolled or cold-worked at an extremely low temperature with industrial difficulty. The low value Md(N) does not assure austenite/martensite transformation for improvement of fatigue strength, on use of the steel strip as a continuously variable transmission belt. Moreover, an austenite phase is more stable as a decrease of the value Md(N), so that a rate of strain-induced martensite does not reach 80 vol. % or more at a surface layer of the steel strip and that it is also difficult to form strain-induced martensite at a rate of 60 vol. % or more with high reliability. As a result, surface nitriding reaction does not progress to an extent necessary for improvement of wear-resistance and fatigue strength. On the other hand, a steel strip, which has a composition with a value Md(N) above 100, is transformed to martensite at a too early stage due to deformation on its use as a continuously variable transmission belt, so that fatigue strength is rather lowered.

After a steel strip is formed to a ring shape, it is ring-rolled by a rolling mill, as shown in FIG. 1. The steel strip 1 is ring-rolled by a couple of work rolls 2*a*, 2*b* during traveling between a tension roll 3 and a return roll 4. A 4-high rolling mill, which has back-up rolls for supporting the work rolls, may be also employed. Such rolling conditions as rolling load, tension and circumferential speed of work rolls are properly determined as follows:

The steel strip 1 is sent to a gap between the work rolls 2*a* and 2*b* and gradually reduced in thickness during traveling along an endless track. During rolling, expansion of the steel strip 1 along its circumferential direction is compensated by elongation of a distance between axes of the rolls 3 and 4 in order to keep a tension, which is applied to the steel strip 1, at a constant value. Loads, which are put on the rolls 2*a*, 2*b*, 3 and 4, are controlled by a load cell 5. The circumferential length of the steel strip 1 is calculated from diameters of the rolls 3, 4 and the distance between the axes of the rolls 3 and 4 measured by a range finder 6.

Figure 2:
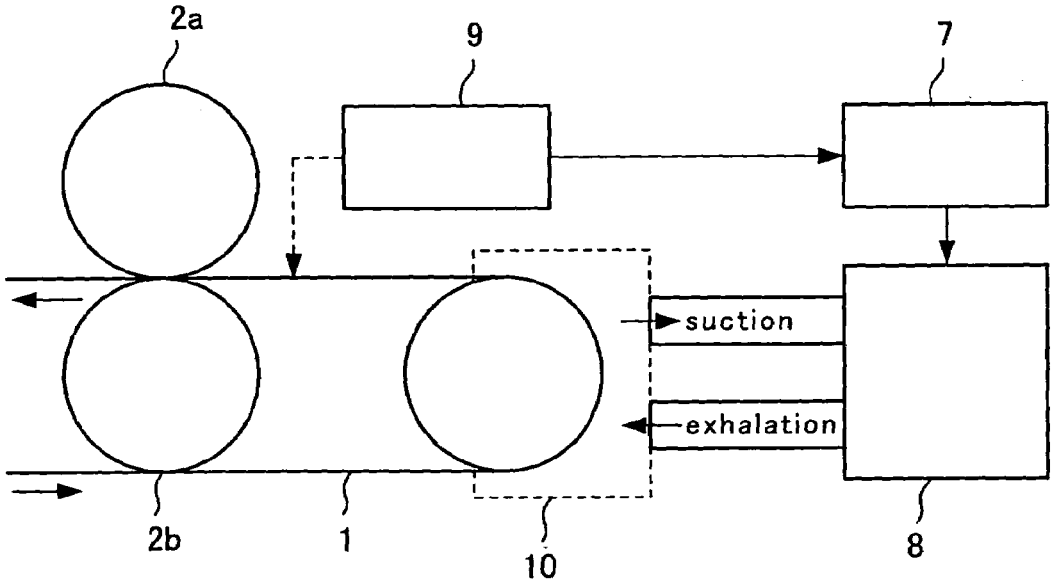
FIG. 2 is a block diagram for explaining a temperature control system.

A material temperature T is kept at a value within a predetermined range by a temperature control system, as shown in FIG. 2. In the temperature control system, a temperature of the steel strip 1 is measured by a noncontact radiation thermometer 9 at a position where the steel strip 1 is just sent to the gap between the work rolls 2*a* and 2*b*. The measured value is outputted to a digital-indicating controller 7. A volume of hot air, which is fed from a generator 8 to a heating box 10, and a volume of waste air, which is returned from the heating box 10 to the generator 8, are controlled by commands from the controller 7, so as to keep the steel strip 1 at a temperature within a predetermined range. Of course, the material temperature T can be kept within the predetermined range by controlling a rolling atmosphere, instead of the temperature control system shown in FIG. 2.

Figure 3:
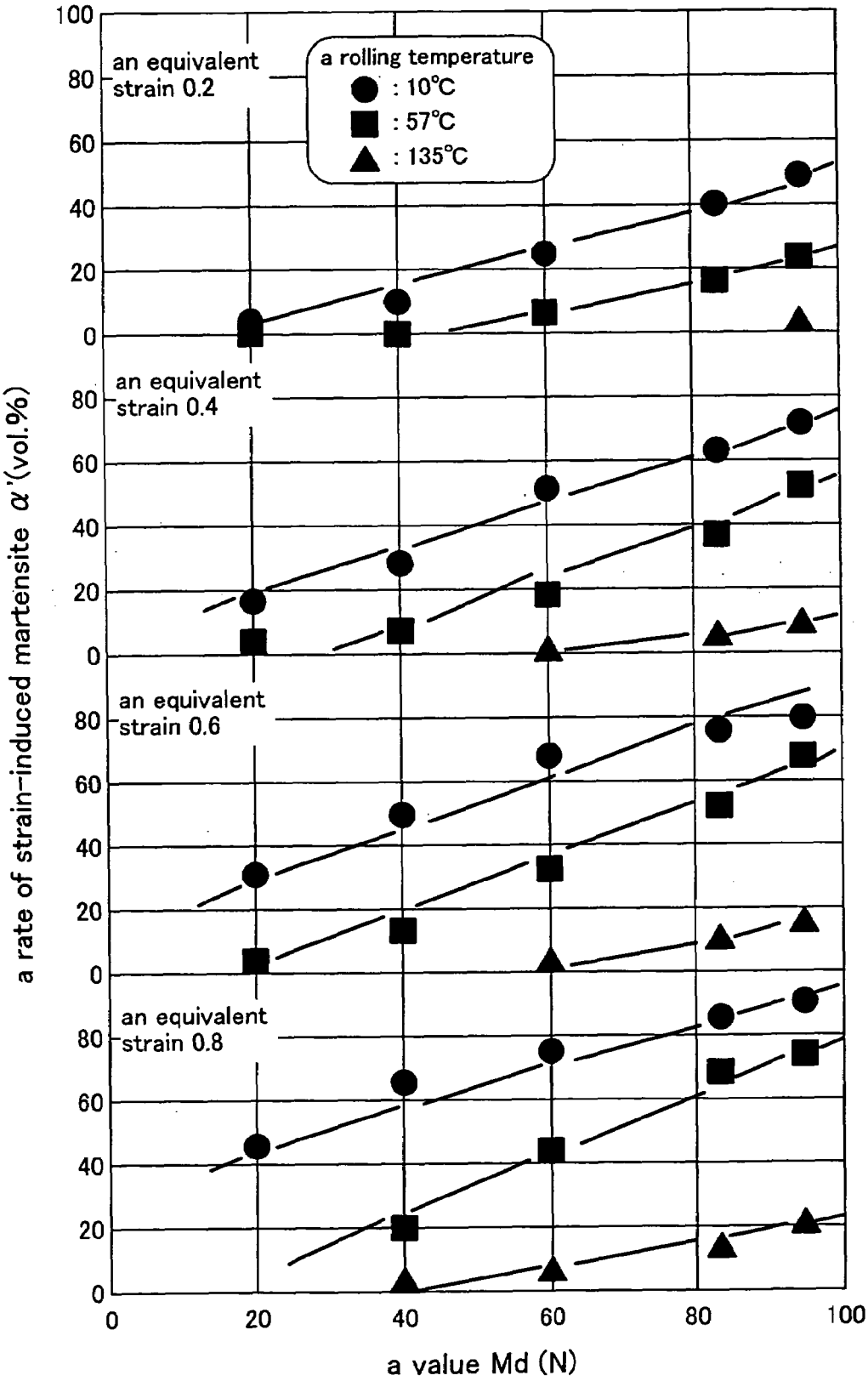
FIG. 3 is a graph showing effects of a value Md(N) and a rolling temperature on formation of strain-induced martensite.

When the steel strip 1 is ring-rolled under the conditions that the value Md(N) and the reduction R are held constant, a rate of strain-induced martensite to a metallurgical structure of a manufactured steel belt becomes bigger as the material temperature T falls down, as shown in FIG. 3. Cross-sectional hardness of the steel belt becomes higher as an increase of strain-induced martensite $\alpha'$. Formation of strain-induced martensite $\alpha'$ is also accelerated by increase of reduction R or a value Md(N), even when the steel strip 1 is rolled at a constant material temperature T.

These effects of the material temperature T, the value Md(N) and the reduction R on formation of strain-induced martensite indicate that a rate of strain-induced martensite in a manufactured steel belt is adjusted to a certain value by interactions of the material temperature T, the value Md(N) and the reduction R. The inventors have arranged the relationship of FIG. 3, which shows the effects of the material temperature T, the value Md(N) and the reduction R on a rate of strain-induced martensite $\alpha'$, by multiple regression analysis and discovered that a relationship of $$\alpha'=-0.3913T+0.5650Md(N)+60.46\epsilon-10.87$$

is established among the rate of strain-induced martensite $\alpha'$, the material temperature T, the value Md(N) and an equivalent strain $\epsilon$, wherein the equivalent strain $\epsilon$ is represented by $\epsilon=\sqrt{4(1n(1-R))^2/3}$ in relation with the reduction R.

Figure 4:
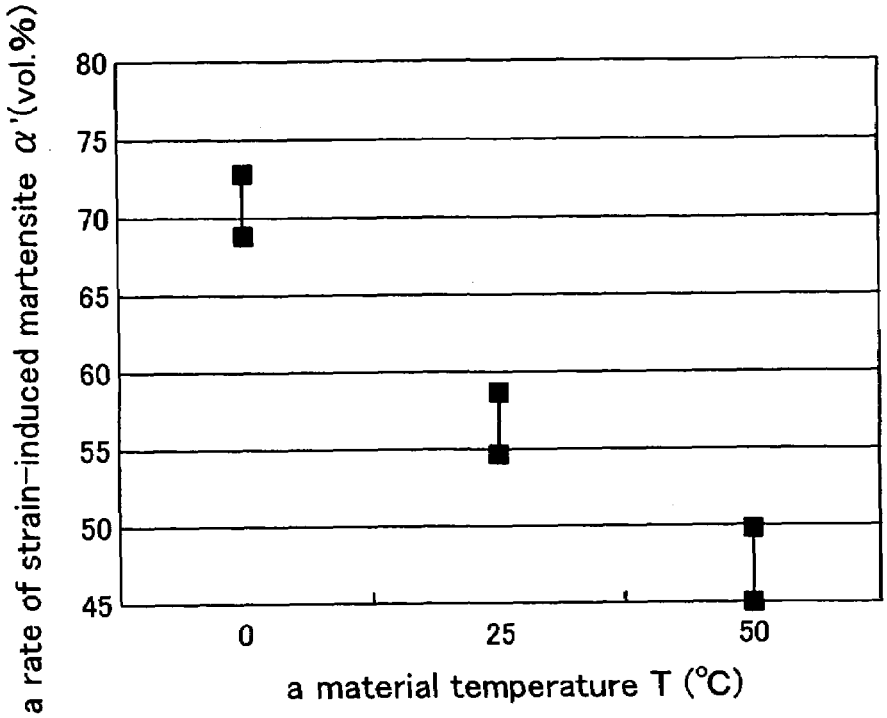
FIG. 4 is a graph showing an effect of a material temperature on formation of strain-induced martensite.

By the way, a steel belt, which is manufactured by ring-rolling a steel strip at a material temperature T of 0° C., 25° C. or 50° C. with a constant value Md(N) and a constant reduction ratio R, has the metallurgical structure that a rate of strain-induced martensite $\alpha'$ is varied in relation with the material temperature T, as shown in FIG. 4. Variation of strain-induced martensite $\alpha'$ also puts effects on fatigue properties of the steel belt.

Figure 5:
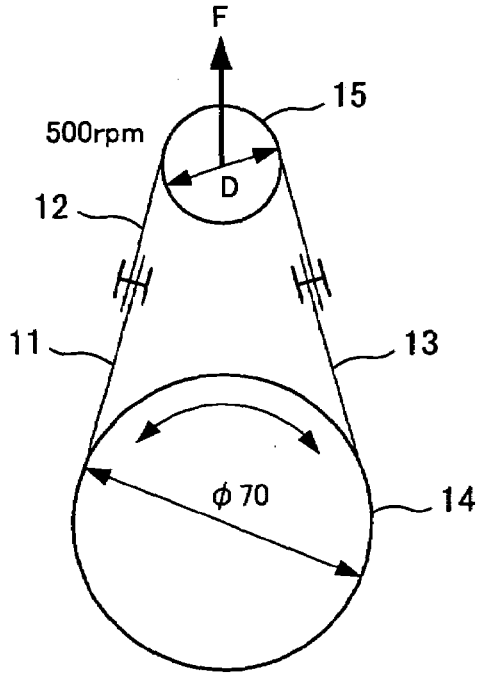
FIG. 5 is a schematic view illustrating a bending-stretching fatigue testing machine for measuring fatigue properties.

In fact, a fatigue test was performed, using a bending-stretching fatigue testing machine, wherein a test piece 12 was fixed to a subsidiary belt 13 with a snap pin 11 and disposed between a driving pulley 14 of 70 mm in diameter and a testing pulley 15 with a diameter D (mm), as shown in FIG. 5. The driving pulley 14 was rotated at 500 r.p.m., while a constant tension F (39.2 N/mm$^2$) was applied to the test piece 12.

Figure 6:
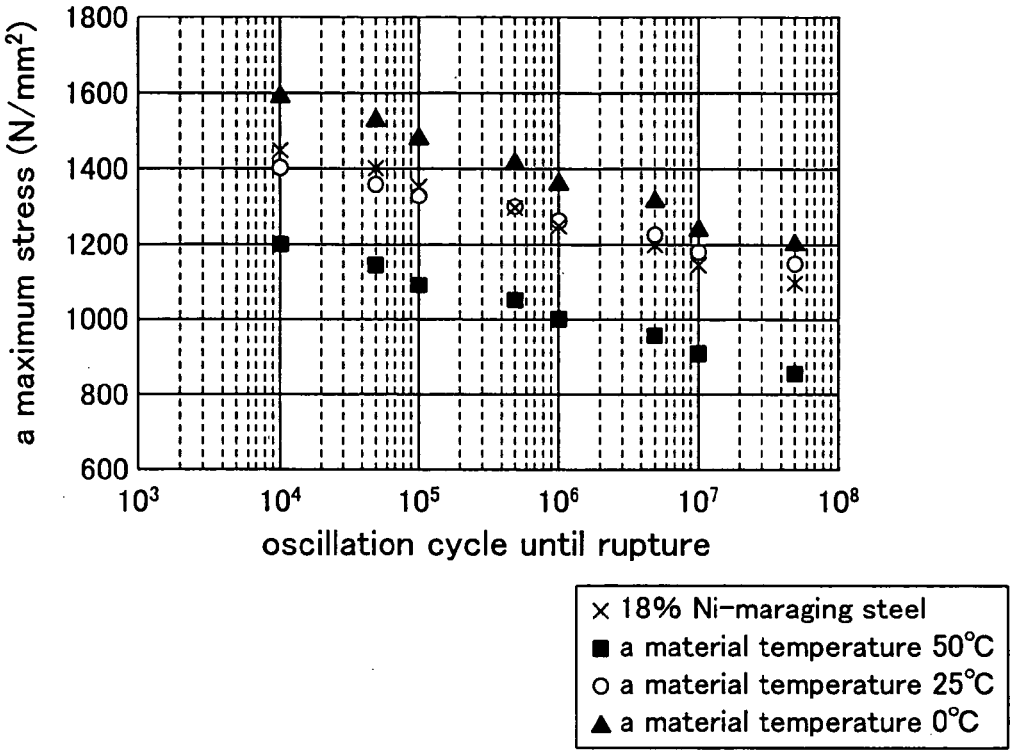
FIG. 6 is a graph showing fatigue properties of a continuously variable transmission belt made of a metastable austenitic stainless steel, which is strengthened by ring-rolling, in comparison with another continuously variable transmission belt made of 18% Ni-maraging steel.

Under these conditions, a maximum stress $\sigma_{max}$ is calculated according to the formula of $\sigma_{max}=T+E\cdot t/2\rho$, wherein E is Young's modulus, t is thickness (mm) of the test piece 12 and $\rho$ is a bend radius [$\rho=(D+t)/2$]. Calculation results in FIG. 6 prove that a fatigue strength, which is substantially the same as a conventional 18%-Ni maraging steel belt, is gained by a rate of strain-induced martensite $\alpha'$ not less than 55 vol. % at a material temperature T of 25° C. or lower. By substitution of $\alpha' \geqq 55$ vol. %, the above-mentioned formula is rewritten to:

$$-0.3913T+0.5650Md(N)+60.46\epsilon \geqq 65.87$$

The rate of strain-induced martensite $\alpha'$ is also variable in relation with an atmospheric temperature during ring-rolling. For instance, dissipation of processing heat is varied in correspondence to an atmospheric temperature different between winter and summer seasons. Variation of the heat dissipation leads to seasonal fluctuations in a rate of strain-induced martensite α', even when a metastable austenitic stainless steel strip is ring-rolled under the same conditions. Fluctuations in the rate of strain-induced martensite α' cause change of deformation-resistance of the steel strip 1, and finally induce deviations of thickness, width and hardness in a manufactured steel belt.

Parameters, i.e. the value Md(N) and the equivalent strain ϵ, in the formula of $\alpha'=-0.3913T+0.5650Md(N)+60.46\epsilon-10.87$ can be regarded as constants, which are determined by a reduction ratio R calculated from an original thickness of a steel strip 1 and a target thickness of a manufactured steel belt. The remaining parameter, the material temperature T, is variance, which is influenced by heat generation and heat dissipation during ring-rolling as well as seasonal change of an atmospheric temperature. In this sense, the formula of $\alpha'=-0.3913T+0.5650Md(N)+60.46\epsilon-10.87$ for determination of a rate of strain-induced martensite α' is rewritten to the formula of $\alpha'=-0.3913T+A+B$ (A and B are constants) involving the material temperature T as only one parameter. The constants A, B are deleted from the formula by handling a variation ΔT of the material temperature T during ring-rolling and a variation Δα' as indices, and the formula is rewritten to $\Delta\alpha'=-0.3913\Delta T$.

Even when a material temperature T is kept at a constant value, a rate of strain-induced martensite α' is fluctuated, as noted in FIG. 4. That is, a deviation of approximately 5 vol. % is noted at any material temperature T of 0° C., 25° C. and 50° C. A rate of strain-induced martensite α', which is formed by ring-rolling under the condition that the material temperature T is kept at a fixed value, is fluctuated with a variation within a range of ±2.5 vol. %. By substitution of $-2.5 \leqq \Delta\alpha' \leqq 2.5$, the formula of $\Delta\alpha'=-0.3913\Delta T$ is rewritten to:

$$-6.4 \leqq \Delta T \leqq 6.4$$

The formula of $-6.4 \leqq \Delta T \leqq 6.4$ means tolerance of the material temperature T for production of a steel belt with stable quality characteristics, wherein a variation Δα' of strain-induced martensite α' is controlled with fluctuations within a range of 5 vol. % when a steel strip 1 is ring-rolled at a constant material temperature T with a constant value Md(N) and a constant reduction ratio R. In short, a variation Δα' of strain-induced martensite α' is confined within a range of 5 vol. % by controlling a material temperature T with a variation within a range of ±6.4° C. during ring-rolling, resulting in production of a steel belt, which has a stable profile with stable quality.

The other features of the present invention will be clearly understood from the following Examples.

EXAMPLE 1

Example 1 used a ring-rolling mill, which had a tension roll 3 and a return roll 4 each of 75 mm in diameter with a couple of work rolls 2*a*, 2*b* of 70 mm in diameter located between the rolls 3 and 4.

A steel strip 1 of 0.35 mm in thickness and 15 mm in width was prepared from a metastable austenitic stainless steel, which had a composition consisting of 0.086 mass % C, 2.63 mass % Si, 0.31 mass % Mn, 8.25 mass % Ni, 13.73 mass % Cr, 0.175 mass % Cu, 2.24 mass % Mo, 0.064 mass % N and the balance being Fe except inevitable impurities with a value Md(N) of 74.03. The specified composition allows formation of a dual phase structure of strain-induced martensite/austenite during aging.

The steel strip 1 was formed to a ring shape with a circumferential length of 611 mm by laser-welding its front and tail ends together.

After the steel strip 1 was disposed between the tension roll 3 and the return roll 4, it was continuously sent to a gap between the work rolls 2*a* and 2*b* along an endless track with a tension of approximately 5 kgf. The steel strip 1 was ring-rolled to a steel belt of 0.20 mm in thickness with a circumferential length of 1070 mm, while controlling a rolling load and a tension applied to the steel strip 1 under the conditions that a maximum rolling load, a circumferential speed of the work rolls 2*a*, 2*b* and a tension of the tension roll 3 were adjusted to 3 ton, 2 m/minute and 200 kgf, respectively. Herein, a reduction ratio R was 42.9%, and an equivalent strain ϵ was 0.647.

Three values, i.e. 0° C., 25° C. and 50° C., were preset as a material temperature T. A surface temperature of the steel strip 1 was measured by the noncontact radiation thermometer 9 at a position where the steel strip 1 was just sent to the gap between the work rolls 2*a* and 2*b*. The material temperature T of the steel strip 1 was feed-back controlled by changing a volume of hot air, which was supplied from the generator 8 to the heating box 10, in response to the measured value.

The rolling conditions are summarized in Table 1.

TABLE 1

| | Rolling Conditions | | | | |
|---|---|---|---|---|---|
| Condition No. | Material temperature T (° C.) | Md(N) | Reduction ratio R(%) (equivalent strain ϵ) | X | Calculated rate α' (vol. %) of strain-induced martensite |
| I | 0 | 74.03 | 42.9 | 80.94 | 70.07 |
| II | 25 | | (0.647) | 71.16 | 60.29 |
| III | 50 | | | 61.38 | 50.51 |

$X = -0.3913\ T + 0.5650\ Md(N) + 60.46\ \epsilon$

Figure 7:
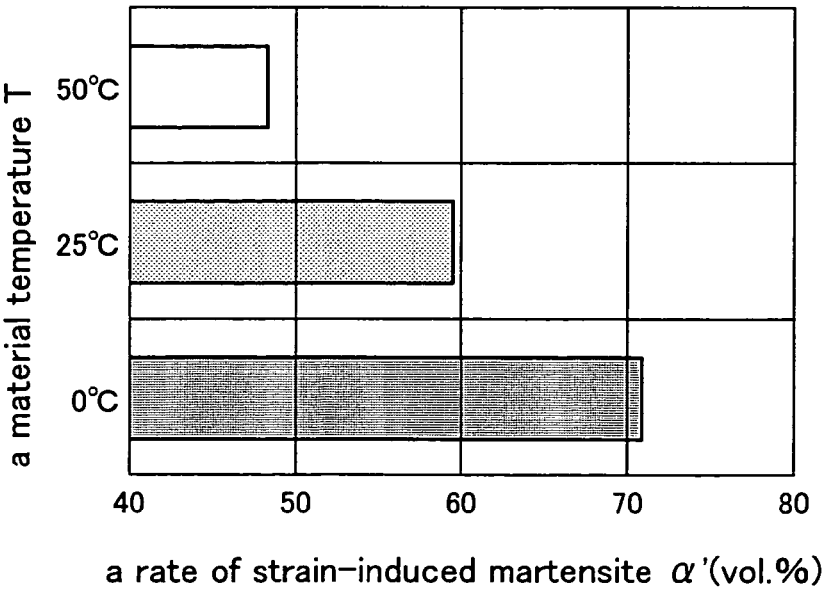
FIG. 7 is a graph showing a rate of strain-induced martensite in relation with a material temperature.

A rate of strain-induced martensite in the steel belt manufactured by ring-rolling was measured. Results are shown in FIG. 7. It is understood from FIG. 7 that a rate of strain-induced martensite α' calculated according to the formula of $\alpha'=-0.3913T+0.5650Md(N)+60.46\epsilon-10.87$ is well consistent with the actual measurement value. In fact, strain-induced martensite was formed at a rate of 55 vol. % or more under the rolling condition No. I or II with a value X of 65.78 or more (in other words, a calculated rate of strain-induced martensite α' being 55 vol. % or more), but a rate of strain-induced martensite α' was insufficient under the rolling condition No. III with a lower value X.

Figure 8:
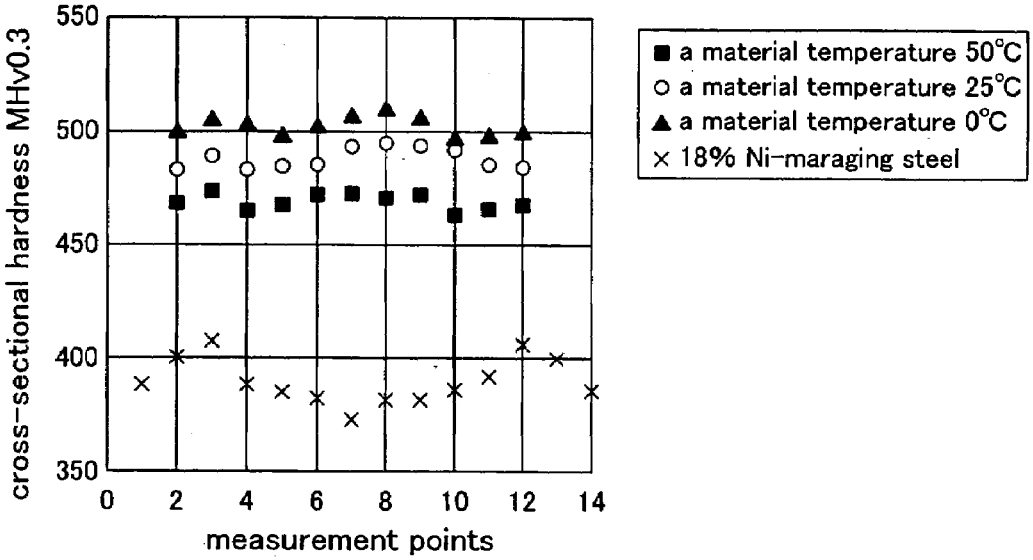
FIG. 8 is a graph showing distribution of cross sectional hardness along a distance from a welding point.
Figure 9:
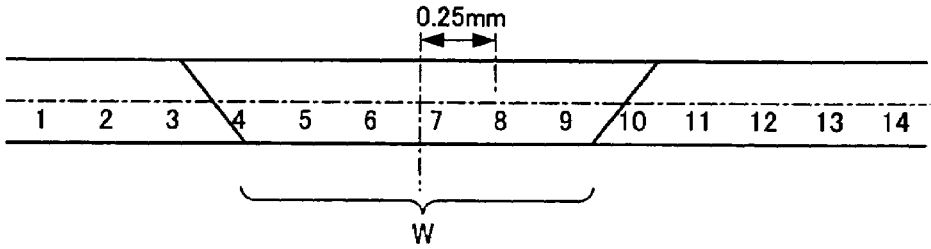
FIG. 9 is a view showing points for measuring cross-sectional hardness in the vicinity of a welding point.

It is noted in FIG. 7 that a rate of strain-induced martensite α' increases as the material temperature T falls down. Cross-sectional hardness of the steel belt was higher as an increase of strain-induced martensite α'. Consequently, the steel belt was more strengthened as falling of the material temperature T, as shown in FIG. 8. The numerals allotted to the abscissa of FIG. 8 represent measurement points preset in intervals of 0.25 mm along a circumferential direction of the steel belt including a welded part, as shown in FIG. 9.

It is confirmed from the above-mentioned results that a rate of strain-induced martensite α' is forecast according to the formula of $\alpha'=-0.3913T+0.5650Md(N)+60.46\epsilon-10.87$ and adjusted to 55 vol. % or more by controlling a material temperature T, an equivalent strain ϵ and a value Md(N) so as to satisfy the condition of $-0.3913T+0.5650Md(N)+60.46\epsilon \geqq 65.87$. As a result, a stainless steel belt excellent in fatigue property and mechanical strength useful for continuously variable transmission is offered.

EXAMPLE 2

A steel strip 1 was formed to a ring shape with a circumferential length of 611 mm from the same metastable austenitic stainless steel as Example 1, by laser-welding its front and tail ends together. The welded steel strip was ring-rolled to a steel belt of 0.20 mm in thickness with a circumferential length of 1070 mm under the same conditions as Example 1 except for controlling a material temperature T to 10±0.5° C. or 30±0.5° C. at the atmospheric temperature of 10° C. or 30° C., respectively.

For comparison, the same steel strip 1 was ring-rolled at an atmospheric temperature of 10° C. or 30° C. without controlling a material temperature T. In this case, the material temperature T was elevated by approximately 10° C. at a position in the vicinity of an exit of the work rolls 2*a*, 2*b*, due to generation of processing heat at any atmospheric temperature of 10° C. or 30° C.

Thickness, width and cross-sectional hardness of each manufactured steel belt were measured at several points along its circumferential direction. Deviations were calculated from the measured values. Calculation results in Table 2 prove that steel belts, which were manufactured at a controlled material temperature T, had substantially uniform thickness, width and cross-sectional hardness with deviations smaller than halves of steel belts, which were manufactured without controlling the material temperature T.

TABLE 2

Effects of control of a material temperature T on deviations of thickness, width and cross-sectional hardness

| | A material temperature T | | | |
|---|---|---|---|---|
| | 10 ± 0.5° C. | | 30 ± 0.5° C. | |
| Temperature control | done | none | done | none |
| Thickness deviation (μm) | 2.0 | 4.4 | 5.1 | 6.3 |
| Width deviation (μm) | 17 | 52 | 19 | 48 |
| Hardness deviation (HV) | 4.5 | 9.8 | 5.9 | 14.7 |

INDUSTRIAL APPLICABILITY

According to the present invention as mentioned above, a rate of strain-induced martensite α', which is formed by ring-rolling a metastable austenitic stainless steel strip, is forecast by the formula of $\alpha'=-0.3913T+0.5650Md(N)+60.46\epsilon-10.87$. When a rate of strain-induced martensite α' is adjusted to a value of 55 vol. % or more by controlling a material temperature T, an equivalent strain ϵ and a value Md(N) so as to satisfy the relationship of $-0.3913T+0.5650Md(N)+60.46\epsilon \geqq 65.87$, a steel belt manufactured by ring-rolling is bestowed with fatigue strength similar or superior to a conventional continuously variable transmission belt made of a 18%-Ni maraging steel. A rolling load is also alleviated by lowering a material temperature T to a lowest possible level and a rolling reduction R. Moreover, a rate of strain-induced martensite α' is controlled to a predetermined value with a tolerance of ±2.5 vol. %, by properly confining a variation ΔT of the material temperature T during ring-rolling. Consequently, a steel belt excellent in quality and dimensional accuracy useful for a continuously variable transmission is manufactured from a metastable austenitic stainless steel.

The invention claimed is:

1. A method of manufacturing a continuously variable transmission belt from a metastable austenitic stainless steel strip, which comprises the steps of:

forming a metastable austenitic stainless steel strip to a ring shape by welding its front and tail ends together;

disposing said ring-shaped steel strip between a tension roll and a return roll;

continuously sending said ring-shaped steel strip through a gap between work rolls, which are located between said tension roll and said return roll; and rolling said ring-shaped steel strip under the condition that the relationship $-0.3913T+0.5650Md(N)+60.46\epsilon \geqq 65.87$ is established among a material temperature T, wherein an equivalent strain ϵ is defined by the equation of $\epsilon=\sqrt{4(\ln(1-R))^2/3}$ wherein R is the reduction ratio and a value Md(N) is defined by the equation of $Md(N)=580-520C-2Si-16Mn-16Cr-23Ni-300N-10Mo$, wherein a variation ΔT of the material temperature T is confined within a range of ±6.4° C. during rolling, and said method is carried out without aging treatment.

2. The manufacturing method defined by claim 1, wherein the metastable austenitic stainless steel strip has the value Md(N) within a range of 20–100.

3. The manufacturing method defined by claim 1, wherein the material temperature T is an atmospheric temperature or a surface temperature of the steel strip at a position where the steel strip is just sent to the gap between the work rolls.

* * * * *